US010263396B2

(12) United States Patent
Tanaka et al.

(10) Patent No.: US 10,263,396 B2
(45) Date of Patent: Apr. 16, 2019

(54) HIGH FREQUENCY DISCHARGE IGNITION DEVICE

(71) Applicant: Mitsubishi Electric Corporation, Tokyo (JP)

(72) Inventors: Takaaki Tanaka, Tokyo (JP); Yasuyuki Shimizu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/700,267

(22) Filed: Sep. 11, 2017

(65) Prior Publication Data

US 2018/0254613 A1 Sep. 6, 2018

(30) Foreign Application Priority Data

Mar. 6, 2017 (JP) ..... 2017-041789

(51) Int. Cl.
*F02P 3/02* (2006.01)
*H01T 13/05* (2006.01)
*H01T 13/06* (2006.01)

(52) U.S. Cl.
CPC ..... *H01T 13/05* (2013.01); *H01T 13/06* (2013.01)

(58) Field of Classification Search
CPC ..... H01T 13/05; H01T 13/06; H01T 13/08; F02P 3/02; F02P 13/00; H01F 38/12
USPC ..... 123/608, 635, 636, 647
See application file for complete search history.

(56) References Cited

U.S. PATENT DOCUMENTS 5,125,386 A * 6/1992 De Filippis ..... F02P 13/00 123/634
6,406,307 B2 * 6/2002 Bungo ..... H01R 13/53 123/635

FOREIGN PATENT DOCUMENTS

JP 2015-78666 A 4/2015
JP 2016-81984 A 5/2016

* cited by examiner

*Primary Examiner* — Hai H Huynh
*Assistant Examiner* — Gonzalo Laguarda
(74) *Attorney, Agent, or Firm* — Sughrue Mion, PLLC; Richard C. Turner

(57) ABSTRACT

A problem exists in that, as a loop through which high frequency energy conducts is long, it is difficult to suppress noise generated from the loop and suppress an influence thereof on peripheral equipment. A high frequency discharge ignition device according to this invention is a structure integrally constituted by a second housing into which a high frequency energy supply circuit is built and a first housing into which an output circuit is built, wherein the high frequency energy supply circuit is connected to the output circuit by a connection terminal so as to be connected to a spark plug which is mounted on a grounded object. Further, the high frequency energy supply circuit is grounded via a conducting member disposed in a through hole provided in the first housing.

20 Claims, 7 Drawing Sheets

HIGH FREQUENCY DISCHARGE IGNITION DEVICE

BACKGROUND OF THE INVENTION

1. Field of the Invention

This invention relates to a high frequency discharge ignition device to be used mainly in an internal combustion engine.

2. Description of the Related Art

In recent years, problems relating to environmental conservation and fuel depletion have been raised, and responding to these problems also represents an urgent task in the automobile industry. As an example of a response thereto, there exists a method in which fuel consumption is improved through engine downsizing using a supercharger. However, if a supercharger is used, pressure in an engine combustion chamber becomes extremely high even in a state where combustion is not occurring, making it difficult to generate a spark discharge for initiating combustion. For this reason, a spark plug gap is narrowed. However, if the spark plug gap is narrowed, loss of thermal energy increases due to the anti-inflammatory effect, that is, the effect by which energy that allows a spark having just been generated to grow is depleted by a low temperature electrode part, which results in the occurrence of a decrease in startability or a decrease in combustibility.

As one solution to this problem, a method has been considered in which thermal energy that exceeds the energy depleted by the anti-inflammatory effect is provided by a spark discharge. For example, Japanese Patent Application Laid-open No. 2015-078666 describes a high frequency discharge ignition device that makes it possible for a high-energy spark discharge to be formed by supplying, to a spark plug, high frequency energy having a high voltage and acquired by coupling high frequency energy boosted by a boosting circuit with a spark discharge generated by a conventional ignition coil.

SUMMARY OF THE INVENTION

With the high frequency discharge ignition device described in Japanese Patent Application Laid-open No. 2015-078666, high frequency energy obtained using a boosting circuit 124 is supplied to a spark plug 101, as shown in FIG. 2 of Japanese Patent Application Laid-open No. 2015-078666. With this device, a loop through which high frequency energy conducts is formed by the boosting circuit 124 and the spark plug 101. As the boosting circuit 124 is located in an area removed from the spark plug 101, the loop is long, as a result, noise generated from the loop is increased.

This invention has been made to solve the abovementioned problem, and provides a high frequency discharge ignition device in which, by shortening a loop through which high frequency energy conducts, noise generated from the loop is suppressed and an influence of this noise on peripheral devices is suppressed.

A high frequency discharge ignition device according to this invention is a high frequency discharge ignition device in which an output circuit couples high frequency energy generated by a high frequency energy supply circuit and a high voltage pulse supplied from an ignition coil and supplies the same to a spark plug, the high frequency discharge ignition device including: a first housing into which the output circuit is built; and a second housing into which the high frequency energy supply circuit is built. The first housing is joined to the second housing, the output circuit includes a connection terminal, the output circuit is electrically connected to the high frequency energy supply circuit by the connection terminal, a through hole is provided in the first housing, a conducting member is disposed in the through hole, and the conducting member is grounded to a grounded object and electrically connected to the high frequency energy supply circuit.

With the high frequency discharge ignition device according to this invention, a high frequency energy supply circuit is directly connected to an output circuit, the output circuit is electrically connected to a spark plug, and the spark plug is grounded, such that the high frequency energy supply circuit is also grounded. Further, the high frequency energy supply circuit is connected to a conducting member which is disposed in a through hole proximate to the output circuit and, as the conducting member is grounded, the high frequency energy supply circuit is also grounded. Accordingly, a loop through which high frequency energy conducts can be shortened.

As a result, a high frequency discharge ignition device can be provided in which noise generated from a loop through which high frequency energy conducts is suppressed and an influence of this noise on peripheral devices is suppressed.

DESCRIPTION OF THE PREFERRED EMBODIMENTS

Figure 1:
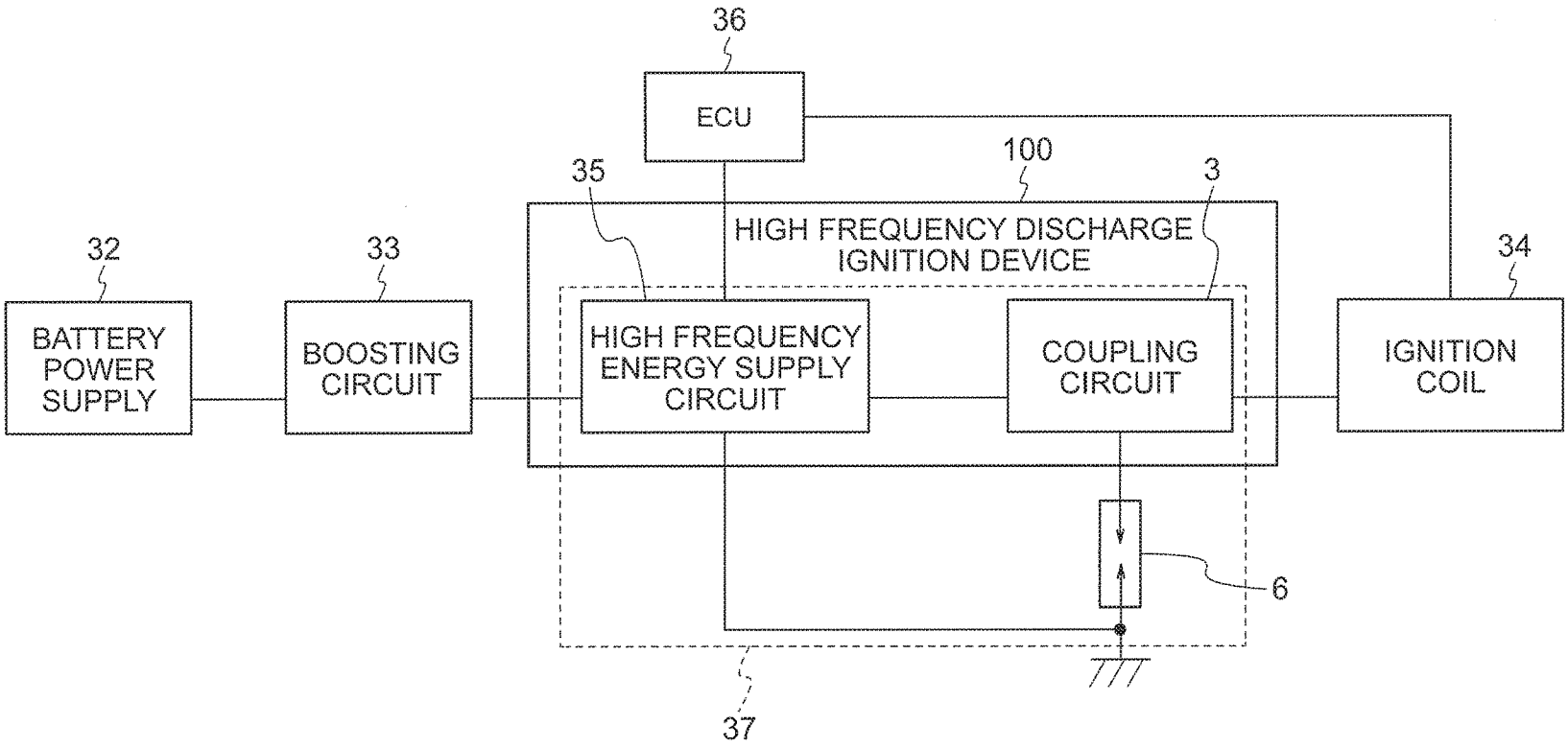
FIG. 1 is a block diagram showing a circuit configuration of a high frequency discharge ignition device and peripheral devices thereof according to a first embodiment of the present invention.

Embodiments of the high frequency discharge ignition device according to the present invention will be described hereinafter using the drawings. Note that identical or corresponding parts will be indicated by identical reference numerals, and redundant description is omitted.

Moreover, in these embodiments, the voltage of a "high voltage pulse" is assumed to be 30 to 40 kV, the voltage of "high frequency energy" is assumed to be 1 to 2 kV, and the frequency of a "high frequency" is assumed to be several hundred kHz to several MHz.

First Embodiment

FIG. 1 is a block diagram showing a circuit configuration of a high frequency discharge ignition device 100 and peripheral devices thereof according to a first embodiment.

The high frequency discharge ignition device 100 is constituted by a high frequency energy supply circuit 35 and a coupling circuit 3. The high frequency energy supply circuit 35 generates high frequency energy using the voltage of a battery power supply 32 having been boosted by a boosting circuit 33 as a power supply. The generated high frequency energy and a high voltage pulse supplied from an ignition coil 34 are coupled by the coupling circuit 3 and supplied to a spark plug 6. Drive control of each circuit is performed by an ECU 36. A loop 37 through which high frequency energy conducts is formed by the high frequency energy supply circuit 35, the coupling circuit 3 and the spark plug 6.

Components of the high frequency discharge ignition device 100 will be described hereinafter using FIG. 2 to FIG. 4.

Figure 2:
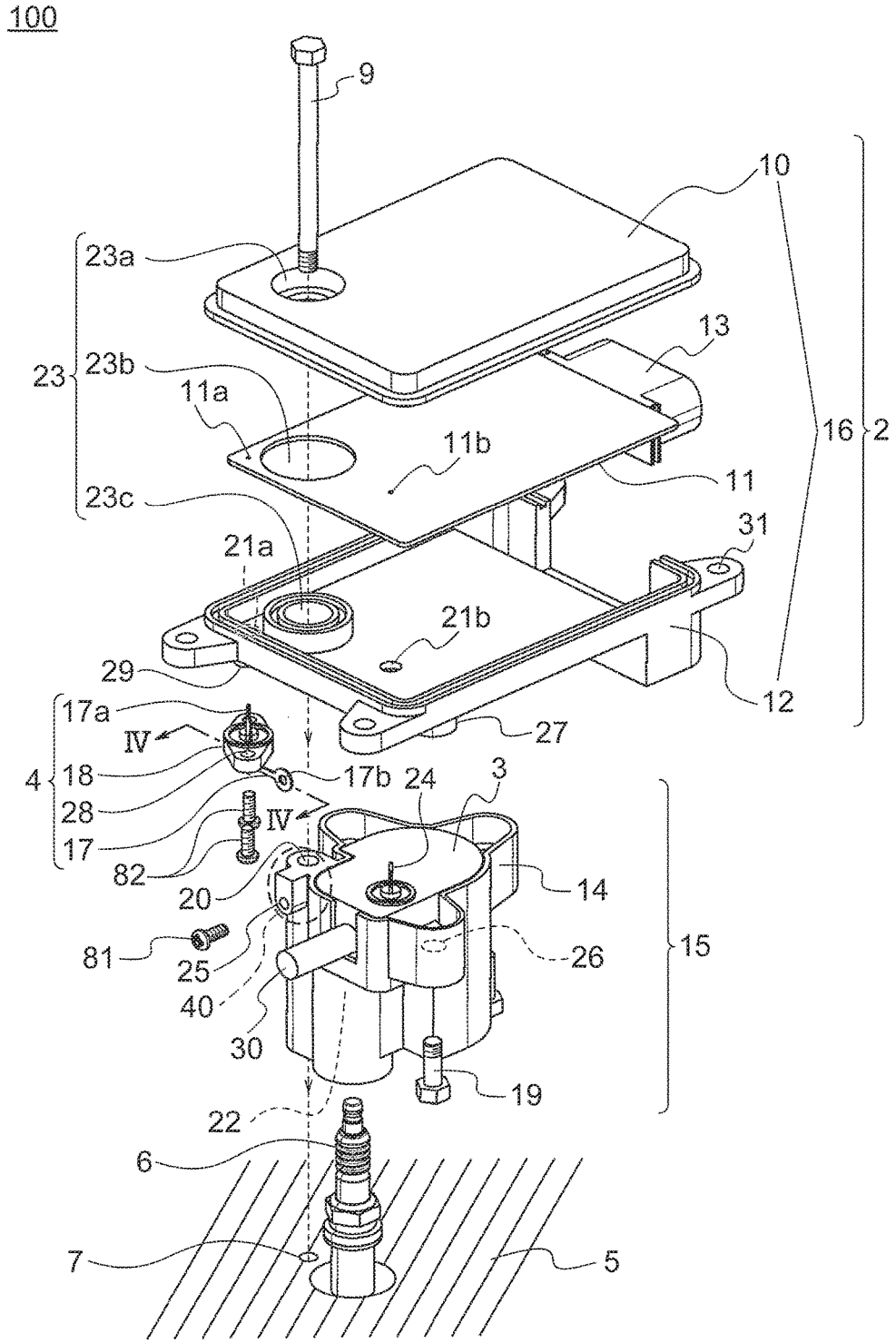
FIG. 2 is a broken-down perspective view showing an internal structure of the high frequency discharge ignition device according to the first embodiment.

FIG. 2 is a broken-down perspective view showing the internal structure of the high frequency discharge ignition device 100. The high frequency discharge ignition device 100 is constituted by an upper unit 2, a lower unit 15, and a terminal ASSY 4, and is attached to a spark plug 6 mounted on an engine 5. Note that hatching has been provided in one area to make the surface of the engine 5 easier to identify.

In the upper unit 2, an electronic circuit board 11 is built into a second housing 16, which comprises a cover 10 and a case 12. The electronic circuit board 11 constitutes the high frequency energy supply circuit 35 shown in FIG. 1, and has electronic components including an input/output circuit, a control circuit, a microcomputer, and a power supply circuit (not shown), and a connector 13. In addition, the electronic circuit board 11 is provided with a through hole 11*a* and a through hole 11*b*. The connector 13 is provided on a side opposite to the through holes 11*a* and 11*b*, and is connected to the boosting circuit 33 shown in FIG. 1. From the perspective of anti-vibration measures and the like, the electronic circuit board 11 is fixed to the case 12 using screws.

The cover 10 and the case 12 are assembled in a vertical direction so as to form a box shape. The cover 10 is fixed to the case 12 using screws, but may also be fixed using an adhesive.

In the case 12, a hole 21*b* and an opening 21*a* are provided so as to pass through the case 12. A boss 27 and a boss 29 are provided on a bottom surface of the case 12. Flange holes 31 are provided at the four corners of the case 12. The case 12 may be fastened to the engine 5 using the flange holes 31.

A hole 23*a* is provided in the cover 10, a hole 23*b* is provided in the electronic circuit board 11, and a hole 23*c* is provided in the case 12. The holes 23*a*, 23*b*, and 23*c* respectively pass therethrough in the vertical direction. The holes 23*a*, 23*b*, and 23*c* are provided coaxially, and constitute a cylindrical space 23 in the second housing 16.

In the lower unit 15, the coupling circuit 3 is built into a first housing 14. The coupling circuit 3 is fixed to the first housing 14 using screws. The coupling circuit 3 constitutes an output circuit.

The coupling circuit 3 has a connection terminal 24, an output terminal 22, an input terminal 30, and electronic components (not shown). The connection terminal 24 is electrically connected to the electronic circuit board 11. The output terminal 22 is mounted on the spark plug 6 of the engine 5. The input terminal 30 is electrically connected to the ignition coil 34 shown in FIG. 1, and the high voltage pulse generated by the ignition coil 34 is supplied thereto.

The first housing 14 is provided with a cylindrical through hole 20, a screw hole 25, and a flange hole 26. The through hole 20 is coaxial to the space 23 of the second housing 16, and a bolt 9 is disposed so as to pass through the space 23. The terminal ASSY 4 is fixed to the screw hole 25. A connecting region 40 between the screw hole 25 and the through hole 20 is subject to processing in order to provide an electrical connection. In the first embodiment, the surface of this portion is subject to plating processing, thereby forming the connecting region 40.

Further, a screw 19 is inserted through the flange hole 26 and attached to the boss 27 of the case 12. As a result, the first housing 14 is joined to the second housing 16. The bolt 9 constitutes a conducting member.

In the engine 5, a screw hole 7 having a female screw thread is provided around the area in which the spark plug 6 is mounted. The bolt 9 is fastened to the screw hole 7. The engine 5 constitutes a grounded object which grounds the bolt 9 and the spark plug 6.

The terminal ASSY 4 is constituted by a base 18 and a connecting member 17, and is attached to the bottom surface of the case 12. The base 18 is provided with flange holes 28. Screws 82 are inserted through the flange holes 28 and screwed into the boss 29 of the case 12. As a result, the terminal ASSY 4 is fixed to the case 12.

The connecting member 17 has an L shape and is constituted by a metallic material. The connecting member 17 has a second connecting portion 17*b* provided with a screw terminal at one end and a first connecting portion 17*a* provided with a bar terminal at the other end.

Figure 3:
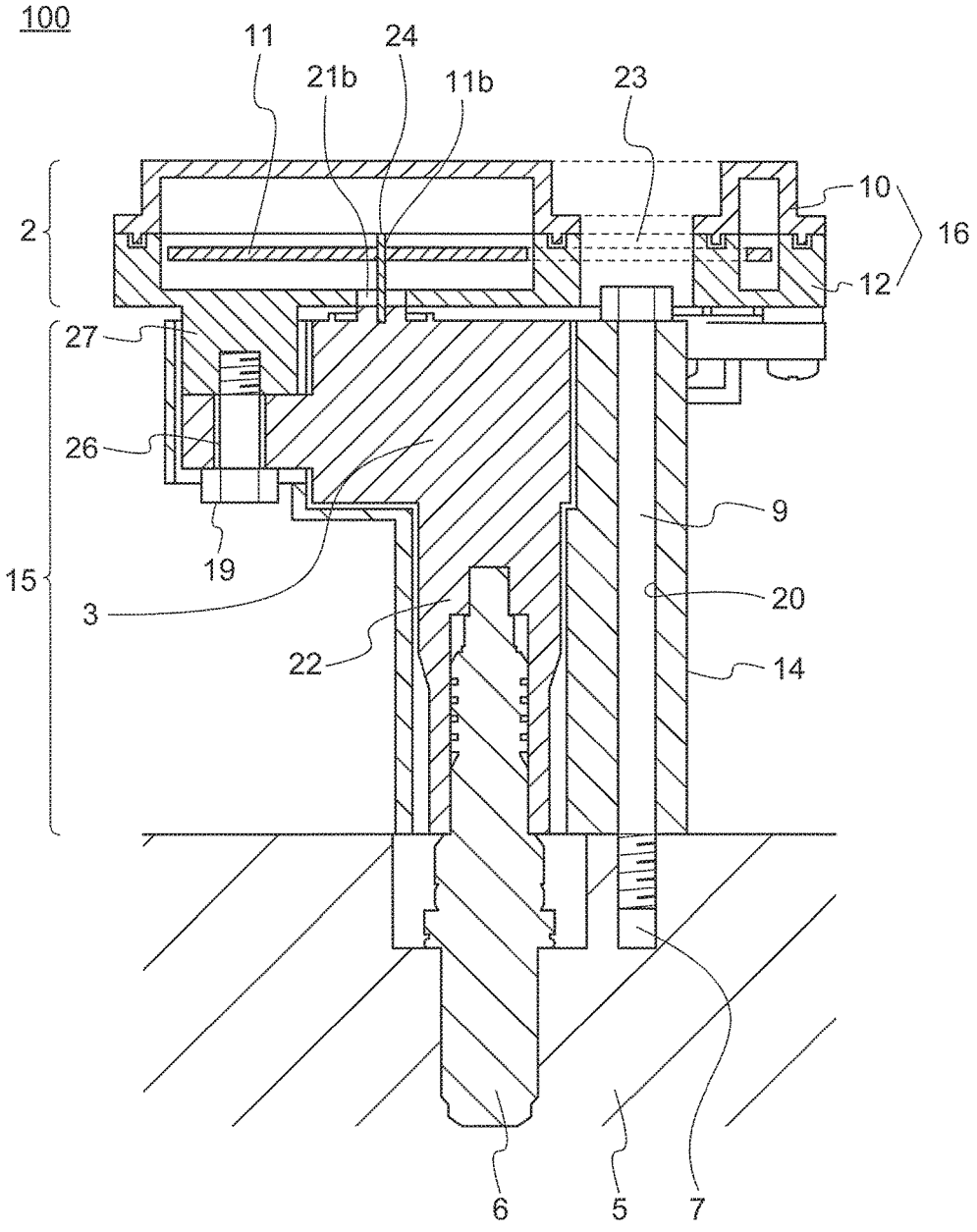
FIG. 3 is a cross-sectional view showing the internal structure of the high frequency discharge ignition device according to the first embodiment.

FIG. 3 is a cross-sectional view including the center line of the spark plug 6 and the center line of the bolt 9 in a state in which the high frequency discharge ignition device 100 is attached to the engine 5.

The connection terminal 24 of the coupling circuit 3 is inserted into an interior of the second housing 16 from the hole 21*b* of the case 12 and soldered to the through hole 11*b* of the electronic circuit board 11. Further, the output terminal 22 of the coupling circuit 3 is mounted on the spark plug 6.

The bolt 9 passes through the space 23 of the second housing 16, is disposed in the through hole 20 of the first housing 14, and is fastened to the screw hole 7 of the engine 5 so as to be fixed thereto.

Figure 4:
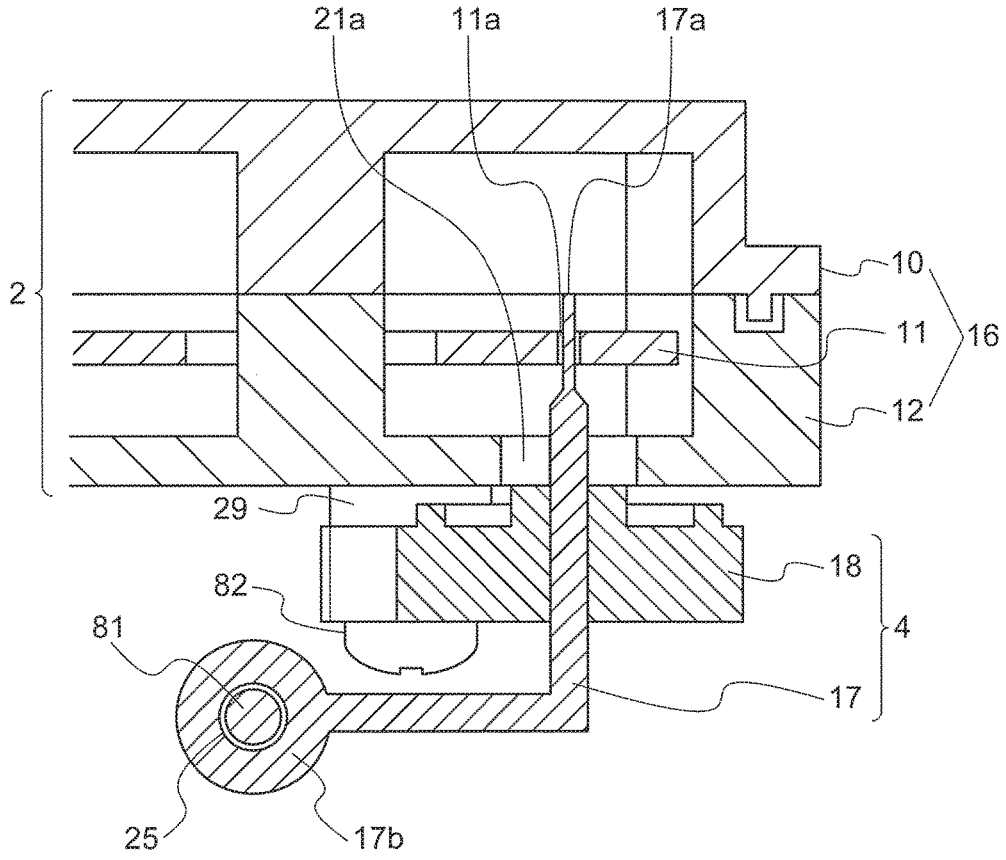
FIG. 4 is a cross-sectional view showing a structure of a terminal ASSY region according to the first embodiment.

FIG. 4 is a cross-sectional view of the terminal ASSY 4 taken along the IV-IV line shown in FIG. 2. As shown in FIG. 4, the first connecting portion 17*a* of the connecting member 17 passes through the opening 21*a* of the case 12, is inserted into the interior of the second housing 16, and is soldered to the through hole 11*a* of the electronic circuit board 11. Further, the second connecting portion 17*b* of the connecting member 17 is fixed to the screw hole 25 of the first housing 14 by a screw 81.

Next, a description will be given of the loop 37 through which high frequency energy conducts in the high frequency discharge ignition device 100 and peripheral devices thereof using the schematic diagram shown in FIG. 5.

Figure 5:
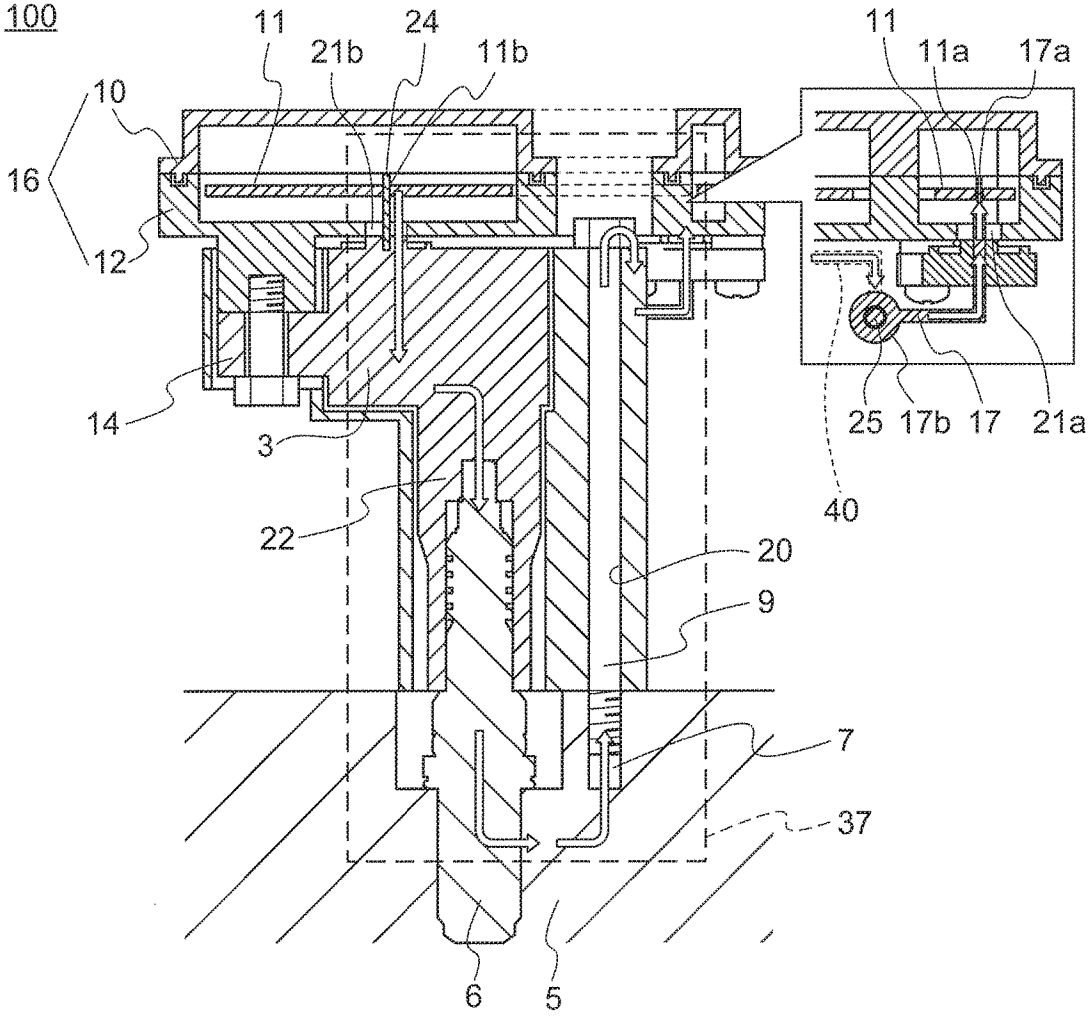
FIG. 5 is a schematic view showing a loop through which high frequency energy conducts in the high frequency discharge ignition device and peripheral devices thereof according to the first embodiment.

In FIG. 5, the cross-sectional view of the main components shown in FIG. 3 is combined with the cross-sectional view of the terminal ASSY 4 shown in FIG. 4. Further, in FIG. 5, the pathway through which high frequency energy conducts is indicated by arrows for the ease of understanding.

The connection terminal 24 of the coupling circuit 3 passes through the hole 21*b* and is soldered to the through hole 11*b* of the electronic circuit board 11. The output terminal 22 of the coupling circuit 3 is mounted on the spark plug 6. The spark plug 6 is mounted on the engine 5.

Accordingly, high frequency energy arrives at the spark plug 6 mounted on the engine 5 from the through hole 11*b* of the electronic circuit board 11 via the connection terminal 24, the coupling circuit 3 and the output terminal 22.

Further, in the connecting member 17, the first connecting portion 17*a* is soldered to the through hole 11*a* of the electronic circuit board 11. The connecting member 17 passes through the opening 21*a*. The second connecting portion 17*b* of the connecting member 17 is fixed to the screw hole 25 of the first housing 14 using the screw 81. The connecting region 40 between the screw hole 25 and the through hole 20 provides an electrical connection. The bolt 9 is disposed in the through hole 20. The bolt 9 is fastened to the screw hole 7 of the engine 5. The bolt 9 is grounded to the engine 5.

As a result, the electronic circuit board 11 is grounded to the engine 5 via the connecting member 17 which passes through the opening 21*a*, the connecting region 40 provided between the screw hole 25 and the through hole 20, and the bolt 9.

Accordingly, high frequency energy arrives at the through hole 11*a* of the electronic circuit board 11 from the engine 5 via the bolt 9, the connecting region 40, and the connecting member 17.

As a result, the loop 37 through which high frequency energy conducts is formed.

In this way, the high frequency discharge ignition device 100 according to the first embodiment is provided with the first housing 14 into which the coupling circuit 3 is built and the second housing 16 into which the electronic circuit board 11 is built. The first housing 14 is joined to the second housing 16, the coupling circuit 3 includes a connection terminal 24, and the coupling circuit 3 is electrically connected to the electronic circuit board 11 by the connection terminal 24. Further, the through hole 20 is provided in the first housing 14 and the bolt 9 is disposed in the through hole 20, and the bolt 9 is grounded to the engine 5 and is electrically connected to the electronic circuit board 11. Due to these electrical connections, the loop 37 through which high frequency energy conducts is formed.

As a result, the high frequency discharge ignition device 100 can be provided, in which noise generated from the loop 37 through which high frequency energy conducts is suppressed and an influence of this noise on peripheral devices is suppressed.

The spark plug 6 is grounded due to being mounted on the engine 5. The bolt 9 is grounded by being fastened to the engine 5 by the screw hole 7 provided around the area in which the spark plug 6 is mounted on the engine 5. As a result, a pathway between the bolt 9 and the spark plug 6 can be shortened.

The opening 21*a* is provided in the second housing 16, and the connecting member 17, which electrically connects the electronic circuit board 11 and the bolt 9, is provided so as to pass through the opening 21*a*. As a result, a pathway between the electronic circuit board 11 and the bolt 9 can be shortened.

The connecting member 17 is electrically connected to the bolt 9 via the connecting region 40 provided on the first housing 14. As a result, a pathway between the connecting member 17 and the bolt 9 can be further shortened.

As indicated above, when the pathways between each component are shortened, the loop 37 through which high frequency energy conducts is shortened, such that noise generated from the loop 37 can be reduced. At the same time, the high frequency discharge ignition device 100 itself can be downsized. As a result, the extent to which shielding is applied to the entire device can be reduced, and noise becomes easier to deal with.

Further, in the high frequency discharge ignition device 100 according to the first embodiment, the bolt 9 serves as a conducting member for connecting the terminal ASSY 4 and the screw hole 7 of the engine 5. The bolt 9 is grounded due to being fastened to the engine 5.

As a result, the loop 37 through which high frequency energy conducts can be formed around the spark plug 6, such that the loop 37 is shortened and the noise generated from the loop 37 can be reduced.

Further, due to the bolt 9 being fastened to the engine 5, the high frequency discharge ignition device 100 is firmly assembled on the engine 5, such that the vibration resistance of the high frequency discharge ignition device 100 is improved. Specifically, the bolt 9 firmly affixes the first housing 14 to the engine 5, and the first housing 14 is joined to the second housing 16 by the screw 19. As the electronic circuit board 11 built into the second housing 16 is relatively vulnerable to vibrations, using the bolt 9 is effective in terms of vibration resistance.

Note that, in order to further shorten the loop 37 through which high frequency energy conducts, it is desirable for the output terminal 22, the through hole 20, and the terminal ASSY 4 to be disposed as close to each other as possible.

In the first embodiment, the cover 10 and the case 12, i.e. the second housing 16, are formed from aluminum, and the first housing 14 is formed from PBT resin. The first housing 14 and the second housing 16 are not limited to the above-mentioned materials, and may also be formed from aluminum, stainless steel, PBT resin, or the like. However, in the first housing 14 of the first embodiment, the connecting region 40 between the screw hole 25 and the through hole 20 must provide an electrical connection. Although plating processing is used in the first embodiment, the material of the connecting region 40 may also be formed from metal or a conductive material similar thereto, or may provide a connection using a part provided with screw terminals at both ends of a conducting wire.

Second Embodiment

Next, a high frequency discharge ignition device 110 according to a second embodiment will be described using FIG. 6. The shape of a connecting member of a terminal ASSY 4 is different from that of the first embodiment.

Figure 6:
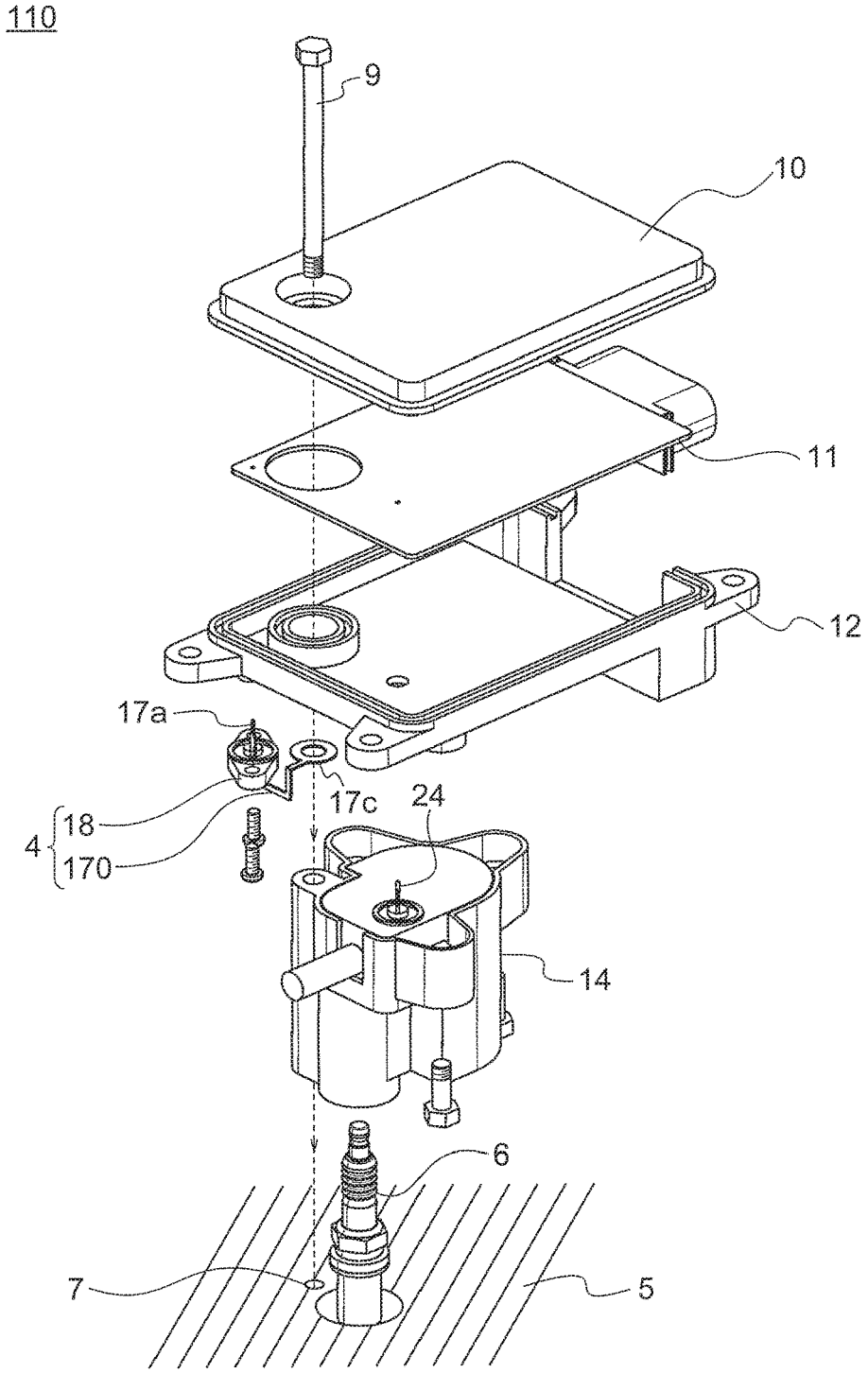
FIG. 6 is a broken-down perspective view showing an internal structure of a high frequency discharge ignition device according to a second embodiment.

FIG. 6 is a broken-down perspective view showing an internal structure of the high frequency discharge ignition device 110. As shown in FIG. 6, a connecting member 170 of the terminal ASSY 4 is U-shaped and has, at one end thereof, a second connecting portion 17*c* which is provided with a screw terminal having a hole that passes therethrough in the vertical direction. The second connecting portion 17*c* is electrically connected to the bolt 9 by being sandwiched between the bolt 9 and the first housing 14.

As indicated above, in the high frequency discharge ignition device 110 according to the second embodiment, the connecting member 170 is electrically connected to the bolt 9 by being sandwiched between the bolt 9 and the first housing 14.

As a result, it is not necessary to use, as described in the first embodiment, the connecting region 40 of the first housing 14 to provide an electrical connection between the connecting member 170 and the bolt 9. Accordingly, it is possible to further shorten the loop 37 through which high frequency energy conducts.

Further, where the first housing 14 is formed from PBT resin or the like, the first housing 14 can be manufactured at relatively low cost without requiring an additional process to provide a conductive region.

Third Embodiment

Figure 7:
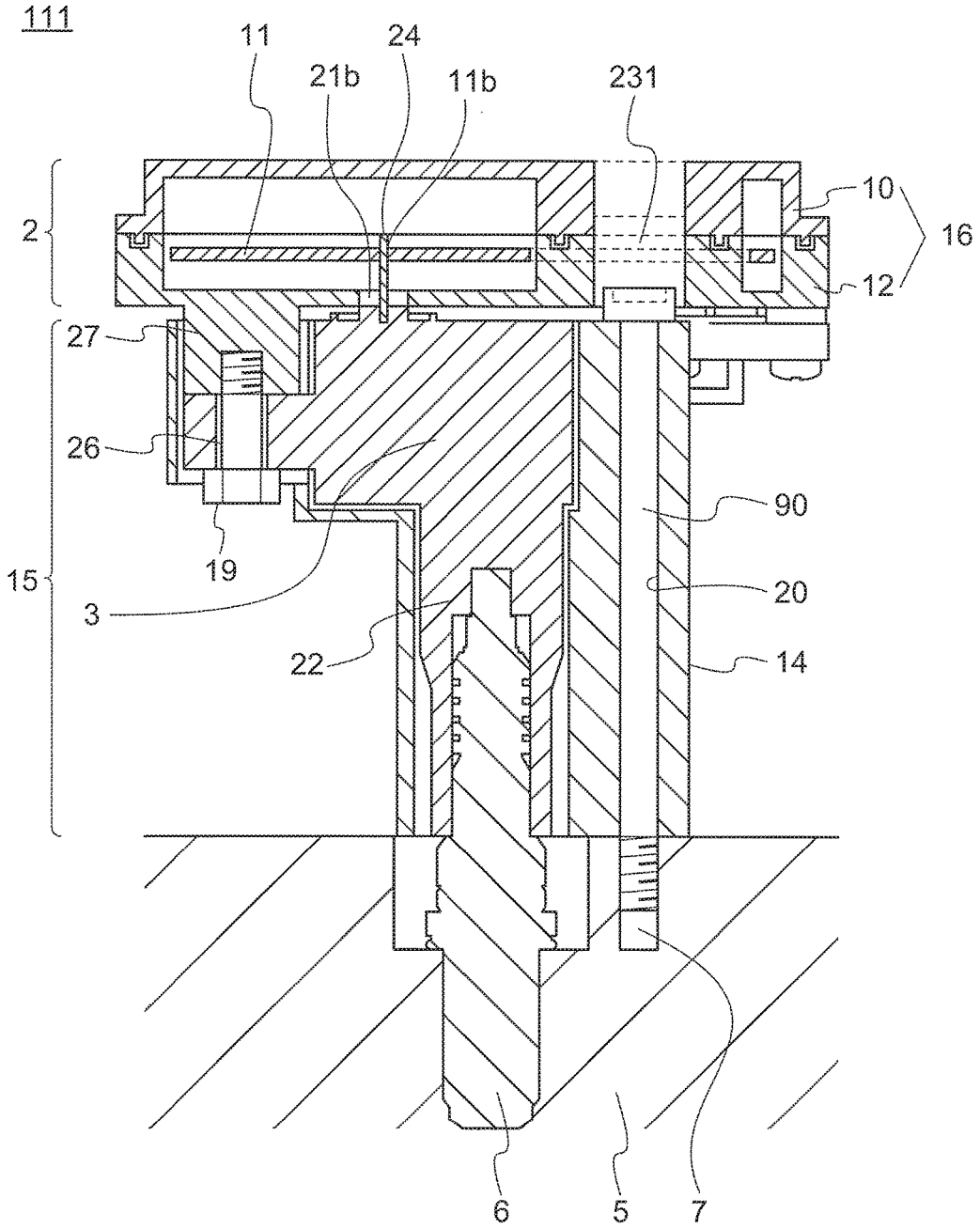
FIG. 7 is a cross-sectional view showing an internal structure of a high frequency discharge ignition device according to a third embodiment.

Next, a high frequency discharge ignition device 111 according to a third embodiment will be described using FIG. 7. In the first embodiment, the conducting member is a hexagonal bolt, however, in the third embodiment, the shape of the bolt differs from that in the first embodiment and is a hexagonal socket head bolt.

When the conducting member is a hexagonal bolt, as in the first embodiment, the diameter of a socket wrench for tightening the bolt 9 is larger than the diameter of the head of the bolt 9. Therefore, when also taking into account an operating range of the socket wrench, the diameter of the space 23 in the second housing 16 through which the socket wrench is inserted must be sufficiently larger than the diameter of the bolt 9.

On the other hand, when the conducting member is a hexagonal socket head bolt 90 as in the third embodiment, the diameter of a hexagonal wrench for tightening the hexagonal socket head bolt 90 is smaller than the diameter of the of the head portion of the hexagonal socket head bolt 90. Accordingly, any diameter of a space 231 of the second housing 16 which allows the hexagonal socket head bolt 90 to be inserted is acceptable, with the result that the diameter of the space 231 can be reduced in comparison to that of the first embodiment.

As indicated above, in the high frequency discharge ignition device 111 according to the third embodiment, the bolt serving as the conducting member is the hexagonal socket head bolt 90. As a result, the hole 23*b* in the electronic circuit board 11 can be made smaller, such that an area in which electronic components can be mounted on the electronic circuit board 11 is expanded. If an electronic circuit is of a similar scale to that of a conventional case, the area of the electronic circuit board 11 can be reduced by area of the hole 23*b*, such that the high frequency discharge ignition device 111 can be downsized.

In the first through third embodiments, a bolt is used as a conducting member, however, press fitting of a metal rod or the like may also be used where vibration resistance is not particularly necessary and as long as electrically similar effects can be obtained.

What is claimed is:

1. A high frequency discharge ignition device comprising:

a high frequency energy supply circuit configured to generate high frequency energy;

an output circuit which couples the high frequency energy and a high voltage pulse supplied from an ignition coil to generate a voltage and supplies the voltage to a spark plug, the output circuit including a connection terminal which protrudes from the output circuit toward the high frequency energy supply circuit and which electrically connects the output circuit to the high frequency energy supply circuit;

a first housing into which the output circuit is built and which comprises a through hole;

a second housing into which the high frequency energy supply circuit is built, the first housing being joined to the second housing;

a member disposed in the through hole, the member having one end grounded to a grounded object: and a connecting member configured to electrically connect another end of the member to the high frequency energy supply circuit, the another end opposing the one end of the member.

2. The high frequency discharge ignition device according to claim 1, wherein the spark plug is mounted on the grounded object, and the member is grounded to the grounded object around an area in which the spark plug is mounted.

3. The high frequency discharge ignition device according to claim 1, wherein the second housing includes an opening, and the connecting member is provided so as to pass through the opening.

4. The high frequency discharge ignition device according to claim 2, wherein the second housing includes an opening, and the connecting member is provided so as to pass through the opening.

5. The high frequency discharge ignition device according to claim 3, wherein the connecting member is electrically connected to the member via the first housing.

6. The high frequency discharge ignition device according to claim 4, wherein the connecting member is electrically connected to the member via the first housing.

7. The high frequency discharge ignition device according to claim 3, wherein the connecting member is electrically connected to the member by being sandwiched between the member and the first housing.

8. The high frequency discharge ignition device according to claim 4, wherein the connecting member is electrically connected to the member by being sandwiched between the member and the first housing.

9. The high frequency discharge ignition device according to claim 1, wherein the member is a bolt, and is grounded by being fastened to the grounded object.

10. The high frequency discharge ignition device according to claim 2, wherein the member is a bolt, and is grounded by being fastened to the grounded object.

11. The high frequency discharge ignition device according to claim 3, wherein the member is a bolt, and is grounded by being fastened to the grounded object.

12. The high frequency discharge ignition device according to claim 4, wherein the member is a bolt, and is grounded by being fastened to the grounded object.

13. The high frequency discharge ignition device according to claim 6, wherein the member is a bolt, and is grounded by being fastened to the grounded object.

14. The high frequency discharge ignition device according to claim 7, wherein the member is a bolt, and is grounded by being fastened to the grounded object.

15. The high frequency discharge ignition device according to claim 8, wherein the member is a bolt, and is grounded by being fastened to the grounded object.

16. The high frequency discharge ignition device according to claim 9, wherein the bolt is a hexagonal socket head bolt.

17. The high frequency discharge ignition device according to claim 10, wherein the bolt is a hexagonal socket head bolt.

18. The high frequency discharge ignition device according to claim 11, wherein the bolt is a hexagonal socket head bolt.

19. The high frequency discharge ignition device according to claim 13, wherein the bolt is a hexagonal socket head bolt.

20. The high frequency discharge ignition device according to claim 5, wherein the member is a bolt, and is grounded by being fastened to the grounded object.

* * * * *